US006430968B2

(12) United States Patent
Juenthner

(10) Patent No.: US 6,430,968 B2
(45) Date of Patent: Aug. 13, 2002

(54) KNITTING MACHINE NEEDLE

(75) Inventor: Kurt Juenthner, Bitz (DE)

(73) Assignee: Sipra Patentenwicklungs - und Beteiligungsgesesslschaft mbH, Albstadt (DE)

( * ) Notice: Subject to any disclaimer, the term of this patent is extended or adjusted under 35 U.S.C. 154(b) by 0 days.

(21) Appl. No.: 09/835,882

(22) Filed: Apr. 16, 2001

(30) Foreign Application Priority Data

Apr. 14, 2000 (DE) ..... 100 18 897

(51) Int. Cl.[7] ..... D04B 35/04
(52) U.S. Cl. ..... 66/121; 66/116
(58) Field of Search ..... 66/122, 121, 120, 66/119, 116

(56) References Cited

U.S. PATENT DOCUMENTS 1,629,454 A * 5/1927 Katzenmoyer ..... 66/122
1,780,790 A * 11/1930 Leavin et al. ..... 66/122
1,884,090 A * 10/1932 Mills ..... 66/122
1,970,187 A * 8/1934 Popper ..... 66/122
2,132,778 A * 10/1938 Cole ..... 66/122
2,184,476 A * 12/1939 Sheppard ..... 66/122
2,429,210 A * 10/1947 Amidon ..... 66/122

FOREIGN PATENT DOCUMENTS

DE 2 014 229 10/1970
DE 40 12 710 A1 12/1990

* cited by examiner

*Primary Examiner*—Danny Worrell
(74) *Attorney, Agent, or Firm*—Michael J. Striker

(57) ABSTRACT

A knitting machine needle is described with a shank (2), provided on one end with a hook (5). According to the invention, the hook (5) has at least one separation edge (15) on its inside (11) for separation of two thread support regions (16, 17), so that the knitting machine needle is particularly suited for performance of platings (FIG. 1).

8 Claims, 3 Drawing Sheets

1
2
6
7
8
9
10
11
12
14
15
16
17
18
5

1
2
6
7
9
10
12
14
15
18
5
v

KNITTING MACHINE NEEDLE

BACKGROUND OF THE INVENTION

The invention concerns a knitting machine needle with a shank, which is provided on one end with a hook that ends at a hook point.

In knitting technology, two or more threads are often simultaneously fed to the knitting needles, in order to achieve special effects. One of these effects is so-called plating (or plaiting) of plain knitwear. Two threads are then fed to the needles so that one thread comes to lie on the front side of the product, especially the right side of the knitwear, while the other thread comes to lie on the left side or reverse of the knitwear, By employing threads with different properties, for example, threads in different colors or threads produced from different materials, different effects and optical impressions can be obtained on the front and reverse of the product. Threads that form the front side are often referred to as "plaiting threads", whereas the threads forming the reverse covered by them are referred to as "base threads". These names, however, are of no significance, in principle, since it merely matters which threads lie on which side of the product and are designed to be visible.

The production of plated knitwear occurs by feeding two or more threads separately to the knitting needles, i.e., introducing them to the needle hooks with preselected spacings from each other. A situation is supposed to be achieved in this way, so that one thread is arranged as close as possible to the needle shank and the other thread as close as possible to the hook point and a good separation effect is achieved on this account. If in special cases a normal, for example, comparatively thick yam, and an elastic, for example, thin yarn (e.g. an elastomer), are simultaneously processed, then the thick yam is often fed close to the needle shank and the thin yam, on the other hand, close to the hook point (DE 2014229 A1).

Despite this thread guiding that appears to be relatively simple, there are invariably difficulties in the production of plated products. One main reason for this appears to be that the threads, during knitting, do not always maintain the position imparted to them during insertion into the needle hooks by the special arrangement of thread guides, so that the plaiting often varies aimlessly and the threads lie in alternation on the front or back An attempt has been made to avoid these difficulties by imparting a shape to the needle hooks that deviates from the usual round shape and tapers to a point in the upper region, in order to avoid sliding of the threads out of their positions. Latch-type needles have also become known (DE 40 12 710 A1), whose latches are wider over a certain length than ordinary latches, in order to avoid sliding of one thread beneath the other during knitting. However, such solutions are more of theoretical significance, because needles of this type are still not offered on the market.

SUMMARY OF THE INVENTION

It is, therefore, an object of tis invention to suggest a knitting machine needle of the kind specified above and being particularly useful for producing plated fabrics.

Another object of this invention is to provide a plating needle of the generic type mentioned above with simple means which make possible to lay two or more threads with preselected spacings into the needle hook.

Yet another object of this invention is to provide the needle hook of the needle above specified with two or more thread support regions which keep the threads in predetermined relative positions during knitting These and other objects are solved in that the knitting machine needle according to the invention has a hook with at least one separation edge on the inside, intended for separation of two thread support areas.

The invention proceeds from the idea of creating two spatially separated zones within the needle hook, one of which serves to receive one thread (for example, the base thread), and other to receive the other thread (for example, plaiting thread). Since the separation edge lies on the inside of the needle hook, it can render effective especially during the needles are drawn down for kiting and keep one thread closer to the needle shank and the other thread closer to the hook point.

Additional advantageous features of the invention are apparent from the subclaims.

The invention is further explained below in conjunction with the accompanying drawings by means of embodiments. In the drawings:

DESCRIPTION OF THE PREFERRED EMBODIMENTS

Figure 1:
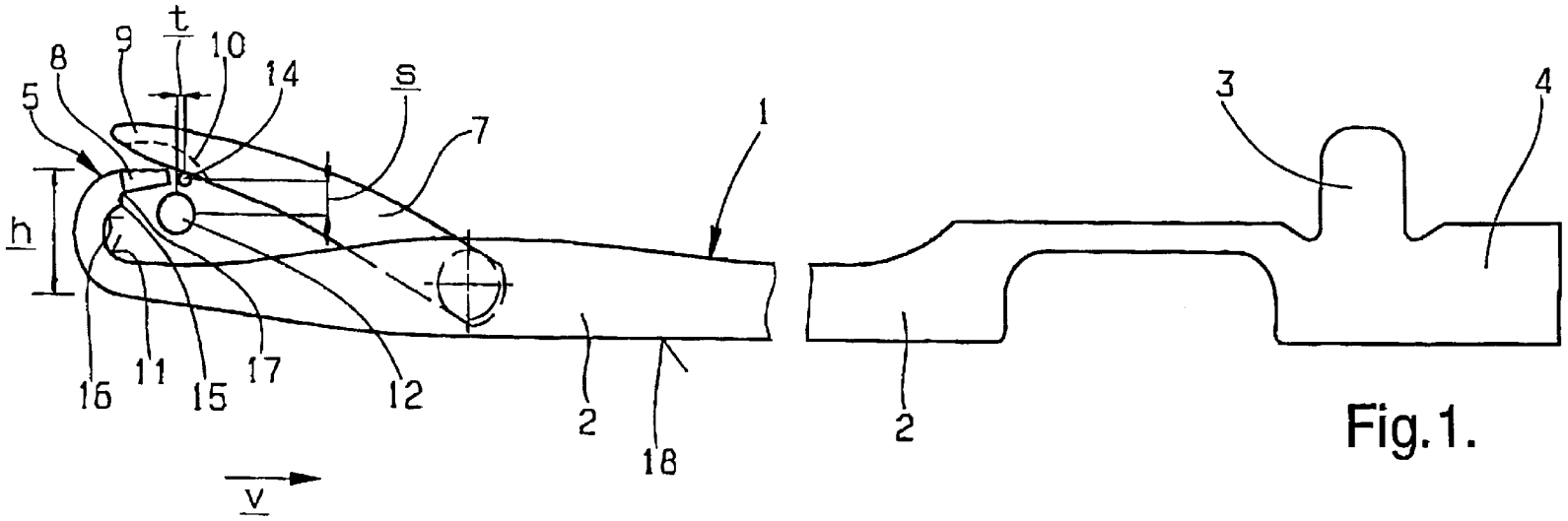
FIG. 1 shows a side view of a first embodiment of a knitting machine needle according to the invention.

In the drawings, only the parts of a knitting machine needle essential for the invention are shown, especially its head or end bent in the fashion of a hook and the adjacent shank part. The other parts of the needle are preferably designed as in ordinary needles and are therefore generally known to one skilled in the art.

In an embodiment of the invention now deemed best, the knitting machine needle is designed as a latch-type needle 1 having a shank 2 provided on one end with a butt 3 and a guide 4 and, on the other end, with a head bent in the form of a hook 5. A latch 7 is mounted to pivot in a part of the shank 2 situated near hook 5 and in a slit of this shank by means of an ordinary axis 6. This latch 7 serves in known fashion to open or close the hook 5 by abutment against a free point 8 of the hook during the knitting process. In the practical example (FIG. 2), the hook point 8, viewed in the direction of its thickness, tapers wedge-like toward the free end, whereas latch 7 has a spoon 9 on its free end with a recess 10, shown with a dashed line in FIGS. 1 and 3 to 6, which spoon 9 almost fully accommodates the hook point 8 in the closed state of hook 5 (FIGS, 4), The hook 5 has an inside 11, which extends essentially along a 180° C. arc and, with the adjacent shank section and latch 7 in closed position, delimits a receiving space for the threads shown in FIGS. 1, 3 and 4, one of which, for example is a thicker base thread 12, and the other a thinner elastomer thread 14.

Figure 2:
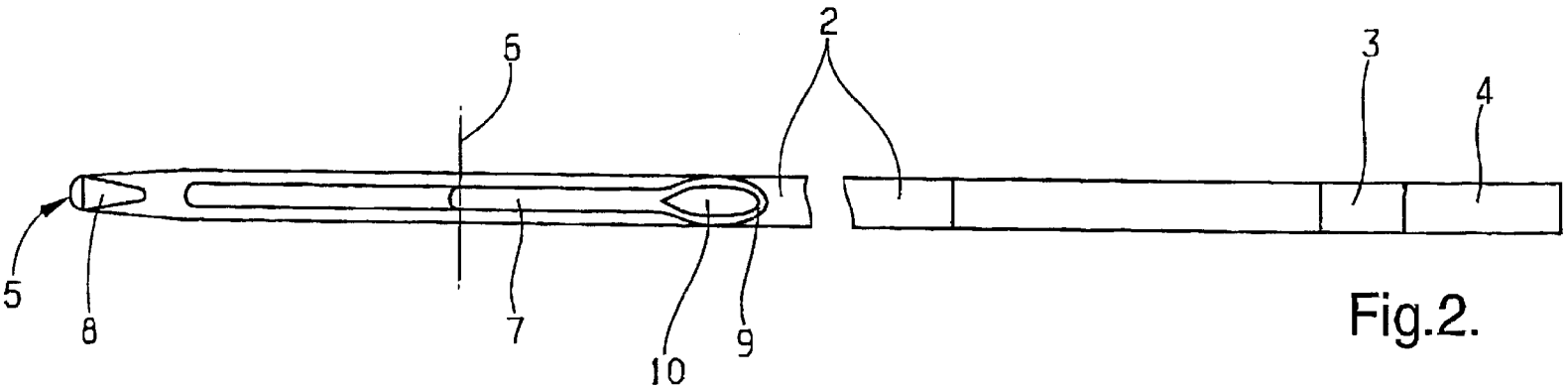
FIG. 2 shows a top view of the knitting machine needles according to FIG. 1 in a fully opened needle latch.

The hook 5 according to the invention is provided on its inside 11 with at least one separation edge 15 that extends into the thread receiving space and which serves to create two support regions 16 and 17 for threads 12 and 14. The separation edge 15 is preferably designed as a shoulder or protrusion protruding from the inside 11. Since the thread 12 is comparatively thick, the support region 16 has a comparatively large extent in the height direction of needle hook 5 appropriate for its accommodation (dimension h in FIG. 1), whereas the support region 17 corresponding to the smaller cross section of thread 14 has a comparatively small extent in the height direction. The support region 17 is also arranged offset in the longitudinal direction of needle 1 by a step relative to support surface 16. Finally, as shown in FIG. 1, the support region 16 lies closer to shank 1 in the height direction, whereas the support region 17 lies closer to the hook point 8. In other words, the spacing of the support region 16 from a needle back 18, or an imaginary extension from it, is smaller than the spacing of the support region 17 from needle back 18.

Figure 3:
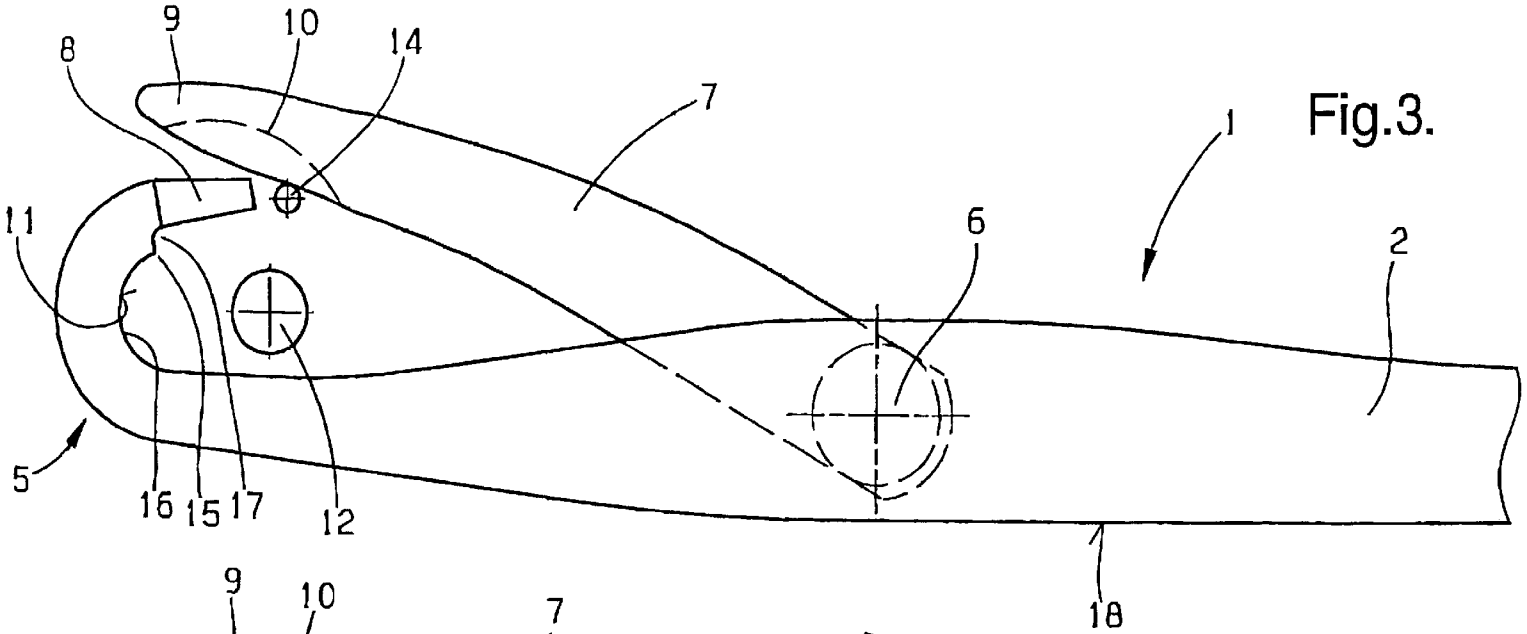
FIGS. 3 and 4 each show an enlarged partial view, corresponding to FIG. 1, of the needle in different positions of a needle latch.
Figure 4:
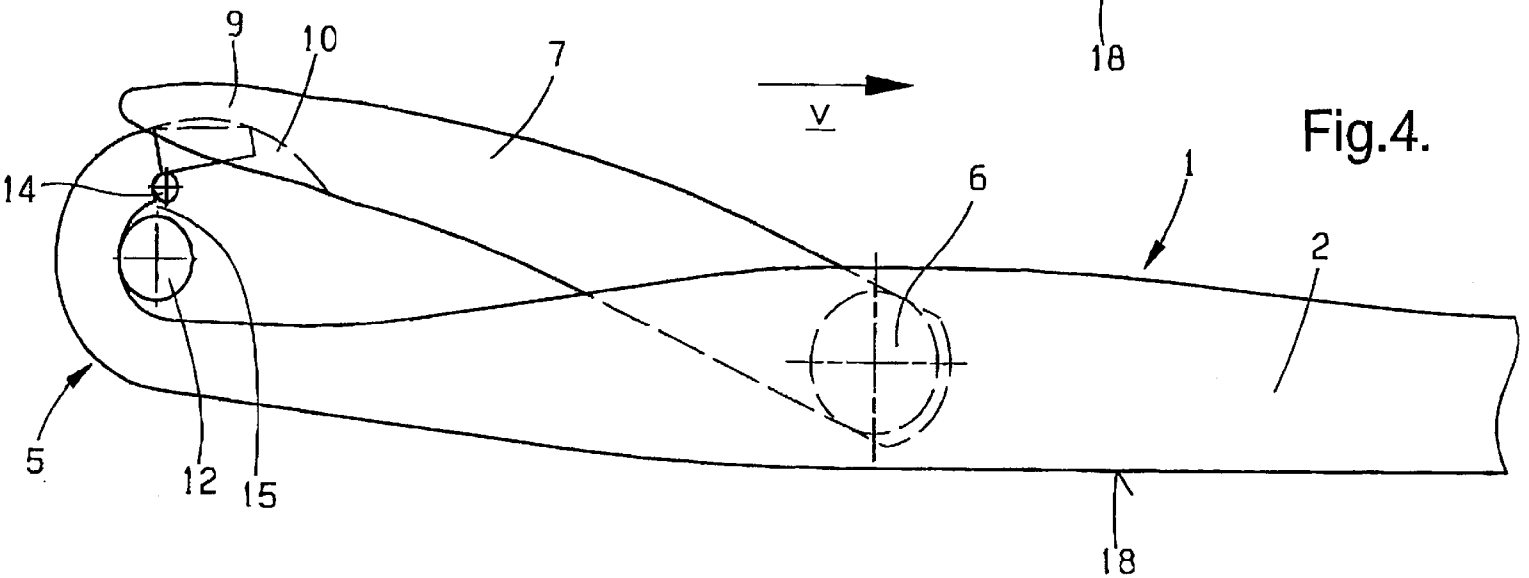

To produce plaited knitwear, the threads 12, 14 are expediently fed separately from the side, in which a spacing s is maintained between threads 12, 14 in a direction perpendicular to both the longitudinal direction of needle 1 and to axis 6. In contrast to one possible variant, in which a spacing t is stipulated between threads 12, 14 parallel to the longitudinal direction of needle 1 and perpendicular to axis 6, it is already ensured, on insertion of threads 12, 14 into needle hooks 5, that the thread 12 fed closer to needle 1 comes to lie closer to shank 2, and the thread 14 further away from needle 1 comes to lie closer to the hook point 8. If needle 1 is then moved in known fashion for knitting in the direction of arrow v, on gradual closure of latch 7, as shown in FIGS. 1, 3 and 4, the thread 12 is placed on the support region 16, while thread 14 is placed on support region 17, the separation edge 15 keeping both threads 12, 14 separate even during subsequent knitting.

Good plaiting is obtained on this account, with the result that thread 12 comes to lie on the right side of the knitwear and thread 14 on the left side.

Since the two support regions 16, 17 are separated in the direction of arrow v by a step, during knitting thread 14 is pulled deeper than thread 12, so that it forms a larger stitch than thread 12. However, no problem arises from this if thread 14 is a highly elastic elastomer thread, since it then springs back after knitting immediately to the same stitch size as thread 12. The practical example according to FIGS. 1 to 4 is therefore preferred for use of threads 14 that are sufficiently elastic.

Figure 5:
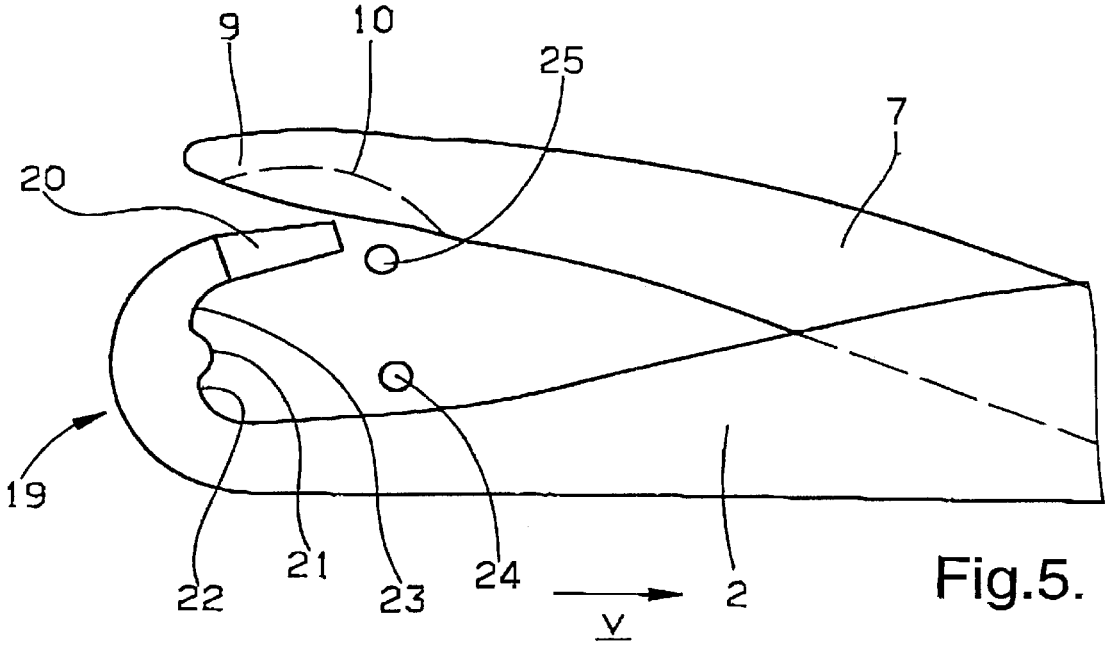
FIGS. 5 and 6 show partial views corresponding to FIGS. 3 and 4 of two additional embodiments of the knitting machine needle according to the invention.

In the variant according to FIG. 5, in which the same parts are provided with the same reference numbers as in FIGS. 1 to 4, a needle hook 19 is provided with a hook point 20, which has two adjacent support regions 22, 23 separated by a separation edge 21 on its inside. The support regions 22, 23 are roughly the same size, since the separation edge 21 lies roughly in the center of the hook, i.e., in the center between the adjacent shank section and the hook point 20. Accordingly, two essentially equally thick threads 24, 25 can also be used. Moreover, the advantage is gained that both support regions 22, 23 end roughly in the same plane, extended perpendicular to the longitudinal direction of the needle, and therefore are arranged without offset in the direction of-arrow v, so that, during knitting, both threads 24, 25 form equally long stitches. Otherwise, the design and use of the needles according to FIG. 5 are substiantially the same as compared with the needle according to FIGS. 1 to 4, i.e., the threads 24, 25 are positioned during knitting on support regions 22 and 23, in similar fashion to FIG. 4.

Figure 6:
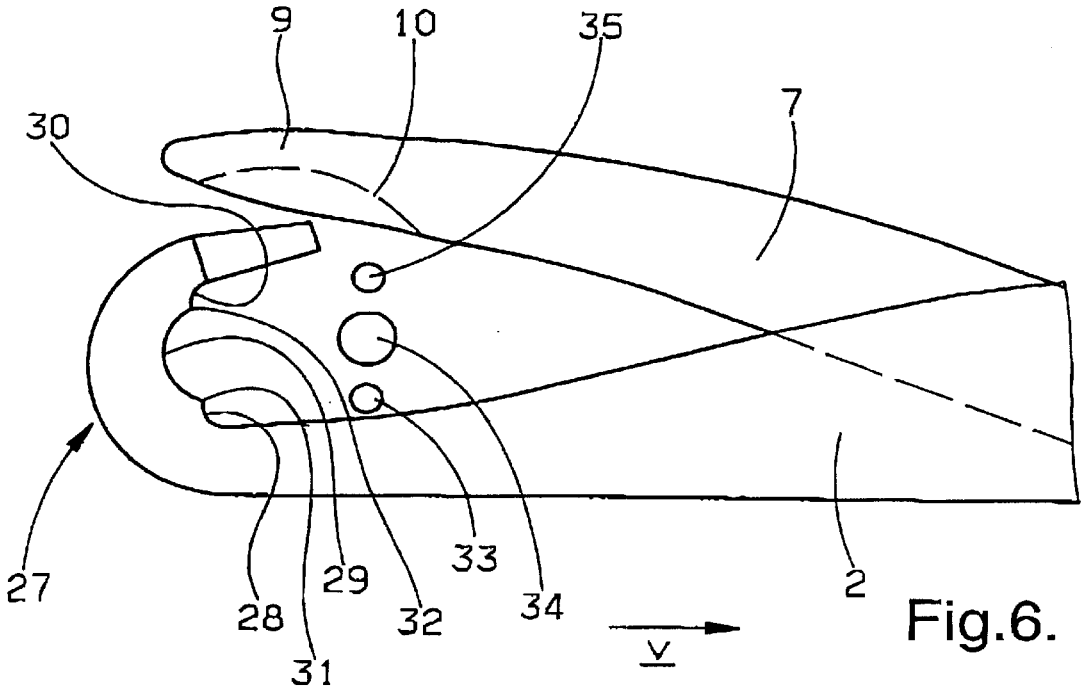

According to FIG. 6, in which the same parts are provided with the same reference numbers as in FIGS. 1 to 5, a third variant of the knitting machine needle according to the invention has a hook 27 with three support regions 28, 29 and 30 arranged one above the other, which are separated from each other by two separation edges 31, 32. The support regions 28, 29 and 30 can be of different size, so to be able to use in the center a thicker thread 33, which is to be covered on the sides with two thinner threads 34 and 35. Otherwise, the details explained with reference to FIGS. 1 to 5 apply accordingly, the support regions 28 to 30 being separated by steps in the direction of arrow v, or also ending in the same cross sectional plane. The threads 33 to 35 are positioned during movement of the needle in the direction of arrow v on the corresponding support regions 28 to 30, being held separate by the separation edges 31, 32.

The invention is not restricted to the described embodiments, which can be modified in a variety of ways. In particular, the separation edges (for example, 21) can be rounded, if required, and/or made longer than shown, in the direction of arrow v. The height of the separation edge, or the dimension by which it extends into the thread receiving space, can be dimensioned, depending on the function desired in the individual case, and larger or smaller. The position of the separation edge can also be different and, in particular, extend to the needle neck. Moreover, needle shapes other than those depicted can be used, which applies, in particular, for the shank region and the number and arrangement of butts, but also for the special hook and latch shapes. Instead of latches with spoons, those having no spoon and with their ends enter a slit formed in the hook tip can be used. The needle heads, as shown in FIGS. 1 to 4, can also be bent up or, as shown in FIGS. 5 and 6, be completely straight (flat). In addition, the invention can also be implemented with latch-type needles different from the usual ones, especially slide or compound needles, double-head needles or double-latch needles, as well as in the production of knitwear other than plain knitwear, for example, right/right wear. Moreover, the needles according to the invention can also be used in flat and circular knitting machines. Finally, it is understood that the different features can also be applied in combinations other than those depicted and described.

It will be understood that each of the elements described above, or two ore more together, may also find a useful application in other types of constructions differing from the types described above.

While the invention has been illustrated and described as embodied in a knitting machine needle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. Knitting machine needle comprising a shank (2) and a hook (5, 19, 27) provided at one end of said shank and ending in a hook point (8, 20), said hook (5, 19, 27) having an inside (11) and at least one separation edge (15, 21) on said inside (11), said edge (15, 21) separating two thread support regions (16, 17 and 22, 23) from each other.

2. Knitting machine needle according to claim 1, wherein sad separation edge (15) lies closer to said hook point (8) than to said shank (2).

3. Knitting machine needle according to claim 1, wherein said separation edge (21) lies roughly in a center of said hook.

4. Knitting machine needle according to claim 1, wherein said hook (27) is provided on said inside with two separation edges (31, 32) for separating of three thread support regions (28, 29, 30).

5. Knitting machine needle according to claim 2, 3 or 4, wherein said thread support regions (16, 17, 28, 29, 30) are offset relative to each other by at least one step in a longitudinal direction.

6. Knitting machine needle according to claim 3, wherein said thread support regions (22, 23) are arranged one above the other without offset in a longitudinal direction.

7. Knitting machine needle according to claim 1, wherein separation edges (15, 21, 31, 32) are rounded.

8. Knitting machine needle according to one of the claim 1, and further being formed as a latch-type needle.

* * * * *